US007055684B2

(12) United States Patent
Anderson

(10) Patent No.: US 7,055,684 B2
(45) **Date of Patent: *Jun. 6, 2006**

(54) DISPENSING CAPSULE FOR A LIQUID CONTAINER

(76) Inventor: Michael R. Anderson, 1355 W. Palmetto Park Rd., No. 129, Boca Raton, FL (US) 33486

( * ) Notice: Subject to any disclaimer, the term of this patent is extended or adjusted under 35 U.S.C. 154(b) by 76 days.

This patent is subject to a terminal disclaimer.

(21) Appl. No.: 10/709,556

(22) Filed: May 13, 2004

(65) Prior Publication Data

US 2004/0195120 A1 Oct. 7, 2004

Related U.S. Application Data

(63) Continuation-in-part of application No. 10/709,062, filed on Apr. 9, 2004, now Pat. No. 6,886,686, and a continuation-in-part of application No. 10/605,873, filed on Nov. 3, 2003, and a continuation-in-part of application No. 10/155,461, filed on May 24, 2002, now Pat. No. 6,644,471.

(51) Int. Cl.
*B65D 25/08* (2006.01)

(52) U.S. Cl. ..... 206/219; 206/221

(58) Field of Classification Search ..... 206/219–222, 206/568; 215/DIG. 8
See application file for complete search history.

(56) References Cited

U.S. PATENT DOCUMENTS

| | | | | |
|---|---|---|---|---|
| 3,156,369 | A | 11/1964 | Bowes et al. | |
| 4,638,927 | A | 1/1987 | Morane | |
| 5,246,142 | A | 9/1993 | DiPalma et al. | |
| 5,370,222 | A | 12/1994 | Steigerwald et al. | |
| 5,692,644 | A | 12/1997 | Gueret | |
| 5,772,017 | A * | 6/1998 | Kang | 206/222 |
| 5,819,923 | A * | 10/1998 | Spring et al. | 206/222 |
| 5,863,126 | A | 1/1999 | Guild | |
| 6,092,648 | A * | 7/2000 | Sellars | 206/221 |
| 6,209,718 | B1 * | 4/2001 | Mollstam et al. | 206/222 |
| 6,769,539 | B1 * | 8/2004 | Stern et al. | 206/222 |

* cited by examiner

*Primary Examiner*—Luan K. Bui
(74) *Attorney, Agent, or Firm*—Malin, Haley & DiMaggio, P.A.

(57) ABSTRACT

A two piece sealed capsule that is inserted through the wall of a liquid, gel, syrup or powder bearing container said capsule being a receptacle for sealably containing a liquid and/or dry material and a dispenser for releasing the material when desired into the container. The top of the capsule is depressed manually forcing a plunger tube connected to the bottom of the capsule to rip away the bottom and side portion dispensing the material. The present invention allows the use of materials that would discolor, degrade or interact with other substances when added to the contents of the container, to remain stable and/or inactive until the time of use.

16 Claims, 9 Drawing Sheets

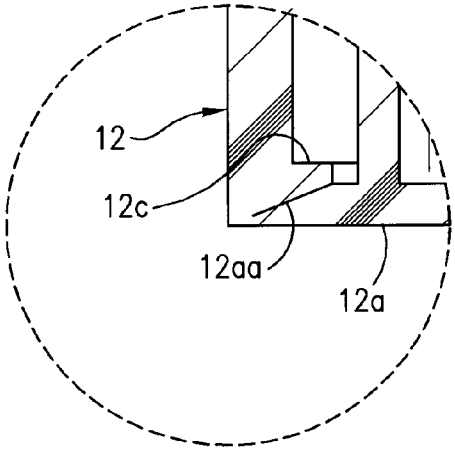
FIG. 4A
FIG. 4
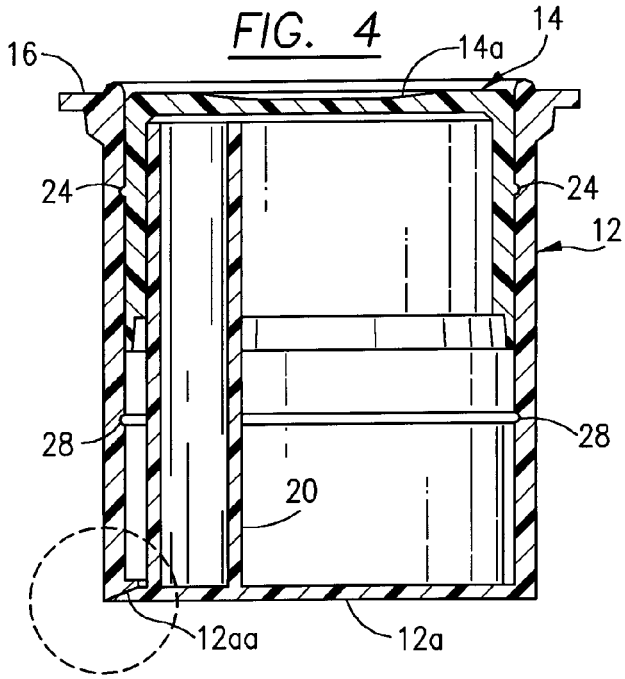
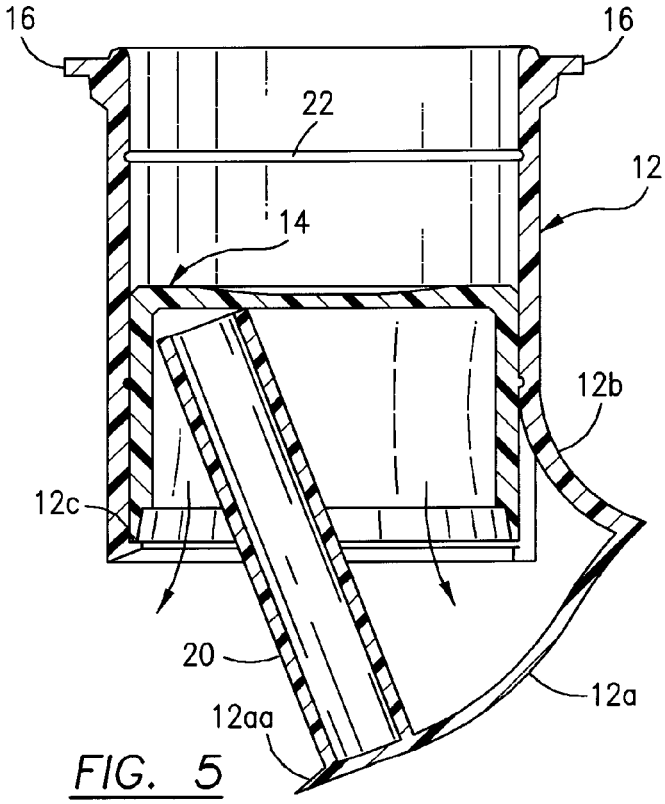
FIG. 5

DISPENSING CAPSULE FOR A LIQUID CONTAINER

This application is a continuation-in-part of U.S. Ser. No. 10/709,062, filed on Apr. 9, 2004, U.S. Pat. No. 6,886,686 and Ser. No. 10/605,873, filed on Nov. 3, 2003 and Ser. No. 10/155,461, filed on May 24, 2002, U.S. Pat. No. 6,644,471.

BACKGROUND OF INVENTION

1. Field of the Invention

This invention relates to a liquid and/or dry ingredient dispensing capsule that is mounted directly to or within the body of a bottle, pack, pouch, carton, tube, can, sealable sandwich bag, or any other liquid or gel container or, alternatively, inserted into the neck or into the cap of the container. The capsule stores liquid and/or dry substances which can be rapidly dispensed into the container by manual activation when desired and the mixed contents can be thereafter readily consumed by the user.

2. Description of the Prior Art

Many foods, drugs, cosmetics, mouth washes, adhesives, polishes, cleansers, dyes and other substances are compounds or mixtures that are frequently supplied in liquid, powder or crystal form and do not retain their stability, strength and effectiveness for long after the ingredients have been mixed in solution or suspension with a different liquid. This incompatibility after mixing therefore mandates that the product be utilized relatively soon after mixture to obtain full strength benefits or to prevent loss of effective strength, deterioration, discoloration, interactions and reduce effectiveness. It is also important that admixtures of various ingredients be done under conditions wherein a measured amount of one ingredient is added to a measured amount of the other liquid or chemical to insure that proper results are obtained. The process of loss of effectiveness is often termed "shelf life." Once two different chemicals are combined, the process of deterioration often begins.

Another concern involves merchandising of certain products, where it is frequently desirable to supply two companion products to the consumer in a single package. Thus, many products are, by their very nature, required to be used by the consumer shortly after their manufacture and mixture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package or added by the consumer. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known. There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

Other product containers are known to include cleaning, health, hair care, hair coloring, cosmetic, drugs, pharmaceutical and dental products. These products also often contain active ingredients having a short shelf life. It would be desirable to separate certain active ingredients prior to use in these containers.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container. Unlike the present invention, the Steigerwald arrangement situates a powder containing receptacle on top of rather than within the container and utilizes a cutting means rather than a two-part sealed plunger means to confine then discharge the receptacle contents.

U.S. Pat. No. 5,863,126 to Guild discloses a baby bottle fluid mixing system comprising a pre-stored powdered substance confined within a first upper container screw disposed atop a second lower container separated by an internal stemmed disk sealed in a snap fit arrangement at the aperture between the bottles, which descends into the lower bottle after removal from the aperture for use. The present invention discloses a capsule body insertable in but not screwed onto a liquid containing bottle and further comprises two sealable plugs or closures rather than one snap fit plug and a disposable, non-reusable interior mounted capsule versus top threaded reusable upper container for pre-stored dry or liquid.

Another such device for separate storage and subsequent mixing of two products was disclosed in U.S. Pat. No. 5,246,142 to DiPalma which comprised a first ingredient container, a second ingredient dispenser compartment plunger arrangement with a weakened wall region inserted within and separated from the container, a removable container closure connected to the plunger and a plunger projection for engagement which ruptures the weakened wall region to release the second ingredient into the first ingredient container. Unlike the present invention, DiPalma's singular sealing means is the reservoir for the second ingredient and fails to create upon activation an orifice for immediate dispensing of the mixed products.

U.S. Pat. No. 5,692,644 to Gueret discloses a container separately storing, then mixing and dispensing two products in which a first liquid containing bottle is separated by a movable wall from a second reservoir containing powder. Force applied to a cylindrical piston in the direction toward the dispensing orifice of the container cuts the seal between the two reservoirs, thereby facilitating the combination and mixing of the two products within the first reservoir of the container. The Gueret apparatus differs from all embodiments of the present invention in that the piston is an integral portion of the slideable base which is snapably attached to the bottle and when compressed with external manual pressure breaks the seals, pushing the contents up into the bottom portion of the liquid-containing bottle thereby accomplishing the mixing of the two products and simultaneously reducing the exterior dimensions of the bottle. The present invention dispenses the dry product without a piston or slideable base integrated within the bottle nor does the overall size of the bottle change during use.

Another separate storage and dispensing device was disclosed in U.S. Pat. No. 4,638,927 to Morane which comprised a bottle for liquid having at its neck a leak proof envelope separately storing and enclosing additional product, with a slidable push button perforator in the cap on the bottle neck which opens the envelope to discharge the envelope contents into the liquid in the bottle, thereafter being dispensed through a duct in the cap rather than passing through the perforated center cap area as is the case with the present invention. Morane is also not a two plug system as is the present invention.

U.S. Pat. No. 3,156,369 issued to Bowes, et al. on Nov. 10, 1964 shows a bicameral container that includes a bottle cap dispenser. No provision is made to retain the dispenser in the container to allow consumption of the mixed ingredients.

Child safety is a concern with respect to dispensing containers to ensure that the dispensing process does not entail creating small frangible items or pieces of foil, paper, plastic, foam or other materials that could harm a child or an adult.

The cost of manufacturing must always be considered in determining whether or not a containing dispenser is practical in everyday use.

The present invention provides a liquid and/or dry ingredients containing capsule that is mounted in the body wall, formed as part of the body wall or inserted into any type liquid container including packs, bags, tubes, spray bottles, cartons, pumps and syringes, cans and plastic or glass bottles. The capsule includes a manual dispenser. The capsule ingredients are completely sealed within the capsule body, and remain separated from the liquid in the container until the exact moment of usage, which is determined by the consumer by manually dispensing the capsule ingredients (powder or liquid). The capsule can also be conveniently mounted or pre-manufactured separately at the factory and added to a container as described herein. The capsule can be mounted to or within any type of package or carton through the package wall at any location. Thus, active ingredients, e.g. activated oxygen, vitamins, herbs, nutrients, drugs, bonding agents or other substances having a short activity life (shelf life) when added to a particular liquid can now be safely and sealably stored in a capsule until time for use and can be subsequently added to the desired liquid, thereby ensuring that the shelf life and time of activity of the materials are not jeopardized even though they are housed within the liquid container. Once activated, the contents of the bottle can be used by the user without removing the capsule. The capsule can be sealably attached to a container wall and protrude on the outside of the container.

The present invention also offers the advantage that it does not require significant modification of existing liquid containers, packages, cartons, bottle caps, tubes or existing bottles. In fact, it can be inserted into existing bottles without interfering with the sealability of the conventional bottle and bottle cap through an aperture in the container wall. The invention could be used in paint cans with concentrate paint colors in the capsule that could be added to white paint. The capsule body can be molded as part of the container wall.

The capsule may be added at the factory to the neck of a liquid bearing container and pre-mounted in the container at the factory after the container itself is partially filled with a liquid or used with an existing container by the consumer. A conventional bottle cap is used to seal the bottle contents, including the capsule. The capsule with its ingredients sealed therein can be sold separately or prepackaged in any type of container.

None of the above prior art taken either alone or in combination, describes, suggests or renders obvious the instant invention as claimed.

SUMMARY OF INVENTION

An ingredient dispensing capsule mounted or mountable in a container for sealably containing a liquid and/or powder materials having substantially a cylindrical or any other shape liquid impervious body of any size or shape but for many cartons, pouches, tubes, sprays, pumps, syringes, packages and bottle liquid containers, sized in diameter to fit either within the inside diameter of a neck, or through the body of a bottle, can, drum, carton, pouch, and the like. The capsule is comprised of two interlocking members that form a sealed capsule that is manually activated to dispense the bottle contents once activated. Although the cylindrical capsule shape is preferred, any other shaped capsule could be utilized if necessary. Liquid or dry ingredients are sealably added to the capsule.

The first member is a cylinder having a sealed closed end and an open end surrounded by an extended annular lip having a plurality of apertures that extend beyond the cylinder wall exterior in one embodiment used in a bottle neck to allow the mixed contents of the bottle to be consumed by drinking out of the bottle. In the preferred embodiment, the first member annular lip does not have flow-by apertures because the capsule is sealably permanently mounted to and in the container wall at the container factory. The capsule is mounted away from the bottle neck and bottle cap opening. The cylindrical member could include a small annular lip that is heat sealed or glued within a circular hole in the container wall. The ingredients are added and the second member mounted and sealed at the bottle factory. Once activated, the mixed ingredients can be poured through the normal bottle cap opening. In an alternate embodiment, the capsule cylindrical first member could be molded as part of the container body.

The first member inside cylinder wall can have an annular groove below the top opening. The first member is made of a liquid impervious material such as plastic, polypropylene and/or polyethylene but not limited thereto. Other materials are suitable. However, the first member could also be made of some other materials. The sealed bottom end wall of the first member is integrally molded with the cylinder wall as a single piece with the bottom end wall having a thinner annular area near its perimeter to act as a weakened fungible bottom end cap. A vertical plunger tube is molded integrally to the upper surface of the first member cylinder bottom end wall and is located and offset from the center of the bottom wall to a peripheral edge of the bottom wall.

The second capsule member (plunger) is a cylinder having an open bottom end and a sealed closed top end. The outside diameter of the second member is less than the inside diameter of the first member, such that the second member fits inside the first member and can be manually pushed as a plunger. The perimeter defining the bottom open end of the second member cylinder formed by the cylinder wall is annular. The second member has an integral molded annular bead or raised seal that fits in an annular groove inside the first member cylinder wall. The plunger tube of the first member extends vertically to almost the top opening of the first member cylinder. The first member cylinder body has a cylindrical wall portion that includes an area of weakening from the bottom wall upwardly on an arc segment of the cylindrical wall approximately half way up the cylindrical wall and about 20 degrees in arc width. In addition, the bottom wall of the first member cylinder has a weakened area around its periphery and is attached as part of the cylindrical wall weakened area to act as one continuous unit of material. When the plunger tube is manually forced downwardly by depressing eh second member (plunger), the first member bottom wall and part of the cylinder wall separate, dispensing the contents, while remaining attached to the first member cylinder and the container wall.

In the preferred embodiment of the invention, the second member sealably fits inside the first member in the unused position, forming an air tight sealed capsule with ingredients stored inside. Since both the first member and the second member are liquid impervious and the second member includes an annular bead near its closed end and the first member has an inside groove near the top of its open end, the first and second members are joined together at the factory after the ingredients which are to be dispensed are first loaded into the first member. The ingredients can be liquid and/or granular, gels, powder, micro-encapsulation or combinations thereof and are placed in the first member at the factory. With the ingredients in place in the first member cylinder, the second member (plunger) is inserted and fits inside the first member containing the ingredients and is pushed downwardly until the annular bead on the second member engages the first member groove that seals. Thus, the capsule has a closed top (plunger) and a sealed bottom (cylinder) that act as a sealed unit with ingredients.

The entire capsule is mounted and sealed permanently onto, through or into the wall of a carton, bottle, package, or flexible or non-flexible container of any type. The capsule is firmly permanently sealably attached through a carton or flexible liquid package wall in a sealed connection.

At the time of use, the capsule second member (plunger) can be manually depressed, forcing the second member downwardly manually until the plunger tube of the first member engages the second member end wall. The rigid plunger tube is forced by depressing the second member downwardly against the first member bottom wall ripping and tearing away portions of the first member or bottom wall and side wall along the lines of weakening causing the contents to be quickly dispensed by gravity into the liquid in the container.

The different types of ingredients and uses are extensive. Packages for hair coloring, kitchen foods such as steak and marinate or herbs, automotive products, cleaning products, drugs and oral tooth care products are a few examples of a variety of products that may require use of two different liquid or powder chemicals that must be separated until actual use.

Once the ingredients are thoroughly mixed with a liquid in the container, the user can drink or pour directly from the container inasmuch as the capsule is mounted away from the container neck and opening and container cap allowing the mixed ingredients to pour, spray, pump or squeeze freely through the container opening. Note that the first member interior wall also includes a flange about a third of the way down from the top that engages the lip of the second member preventing the second member from being plunged or forced into the container and stopping the mixed ingredients from leaking back out of the container. The plunger tube also prevents the second member from falling into the container.

One of the advantages of the present invention is that it does not require additional thin foil seals at either end. The capsule, once sealed at the factory, is self-contained and can be sold independently and later put into a liquid container, pouch, carton, jug, can or the like or can be added at the factory when the liquid is added to any type of container. The purpose of having a separate containers is to extend the shelf lives of the combined ingredients contained within the capsule with the container ingredients. Many ingredients have a short shelf life once added to a liquid such as water or other drink. By having the individual capsules that are completely sealed until the time of use, the active ingredients can be kept separate from the main ingredient such as the liquid in the bottle, carton, package or container.

In an alternate embodiment of the invention, the second member (plunger) closed end could be modified to have a center hole for use with a drinking straw sealed by a removable cover having adhesive or any other type seal. The first member upper perimeter lip apertures would no longer be necessary to permit the user to pour the mixed ingredients out of the container or drink from the container with a drinking straw. Liquid could flow through the hole in the second member once the first member bottom cap is ruptured or through a straw.

In the preferred embodiment, the capsule is sealably mounted and sealed to the body of a container or package, not inserted at the cap opening. The container could be molded so that one segment of the capsule is formed with the container body. No flow-by annular lip apertures would be necessary. The capsule could also protrude from the container body.

The capsule can be manufactured of any type material or combination of materials.

In yet another embodiment, the capsule could have two or more compartments formed with dividers to separate different chemicals for dispensing from one capsule.

It is an object of the invention to provide an insertable or permanently mounted capsule that includes active or non-active ingredients that can be readily dispensed into any type of container housing a second different ingredient at a desired time, thus not interfering with the shelf life or physical/chemical integrity of the ingredients to be combined.

It is an object of this invention to provide a liquid and/or dry ingredient bearing receptacle that includes a dispenser to allow consumers to dispense the liquid, gel, syrups or powder into the liquid bearing container, pouch, package, carton at any time, the capsule being housed within the liquid containing container in a sealed condition.

Still another object of this invention is to provide for sanitary release of the desired ingredients from a capsule of any size or shape into a liquid-containing package at a time selected by the consumer.

In accordance with these and other objects which will become apparent hereinafter, the instant invention will now be described with particular reference to the accompanying drawings.

BRIEF DESCRIPTION OF DRAWINGS

FIG. 4 is a front elevational view in cross section of the invention in a non-activated mode shown without ingredients.

FIG. 4A is a cutaway view of the bottom wall and cylinder wall intersection in cross section.

FIG. 5 is a front elevational view in cross section as the invention would appear after activation. The opposite side view would be a mirror image thereof.

DETAILED DESCRIPTION

Figure 1:
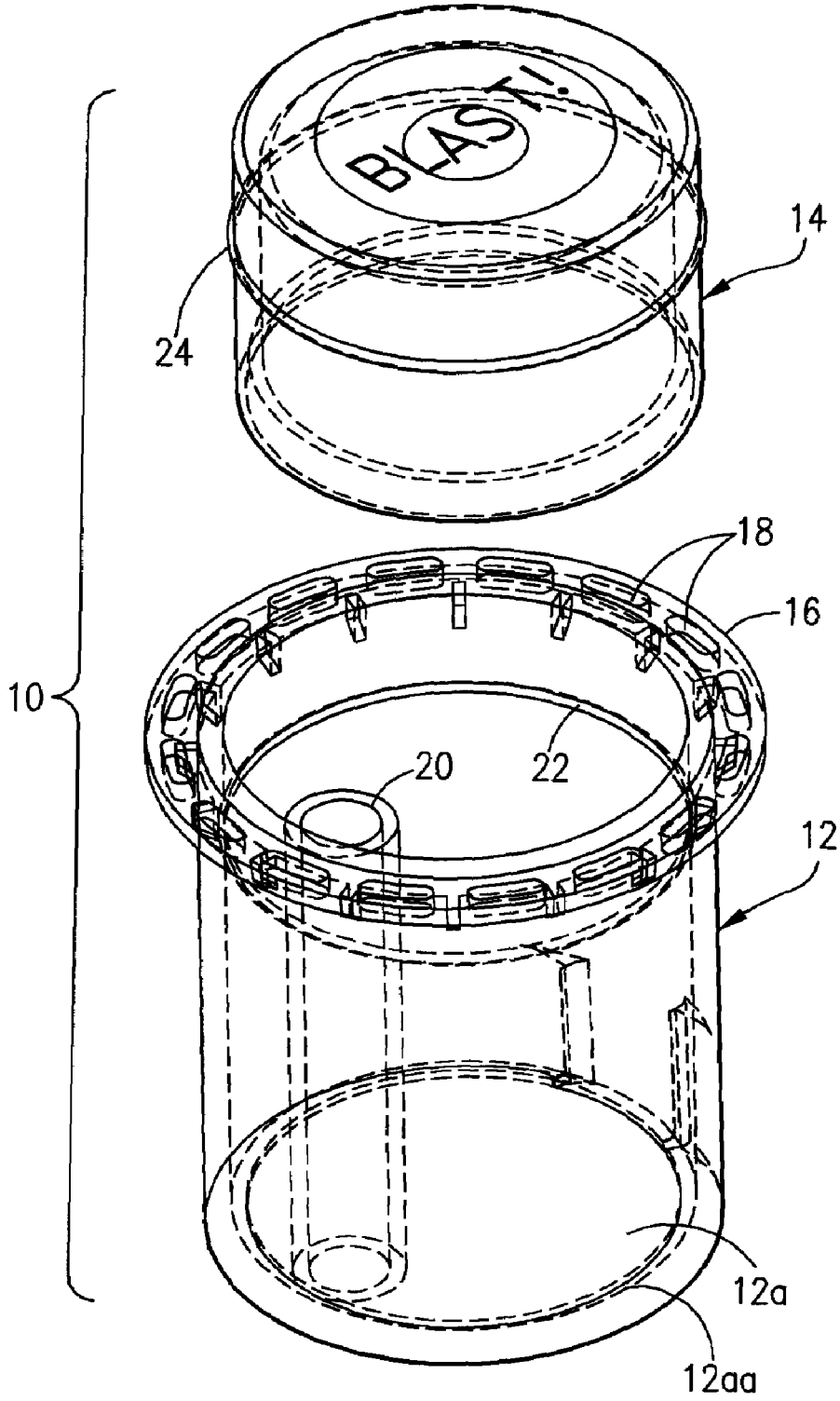
FIG. 1 shows an exploded perspective view of the present invention.

Referring now to the drawings and in particular FIG. 1, the present invention is shown in FIG. 1 at 10 comprised of a cylindrical water impervious plastic first member 12 having a cylindrical body that includes a sealed bottom 12*a* that is integrally formed with the cylinder 12 through a weakened wall area 12*aa* which defines the perimeter of the bottom of the first member 12. An annular lip 16 is positioned around the top opening of the cylinder 12 and includes a plurality of apertures 18 disposed around the perimeter that extend beyond the inside wall of the first member cylinder 12. The interior wall of first member 12 includes an annular groove 22 that receives a bead on the second member 20. A plunger tube 20 also engages second member 14 preventing second member from falling into the container (not shown).

Figure 2:
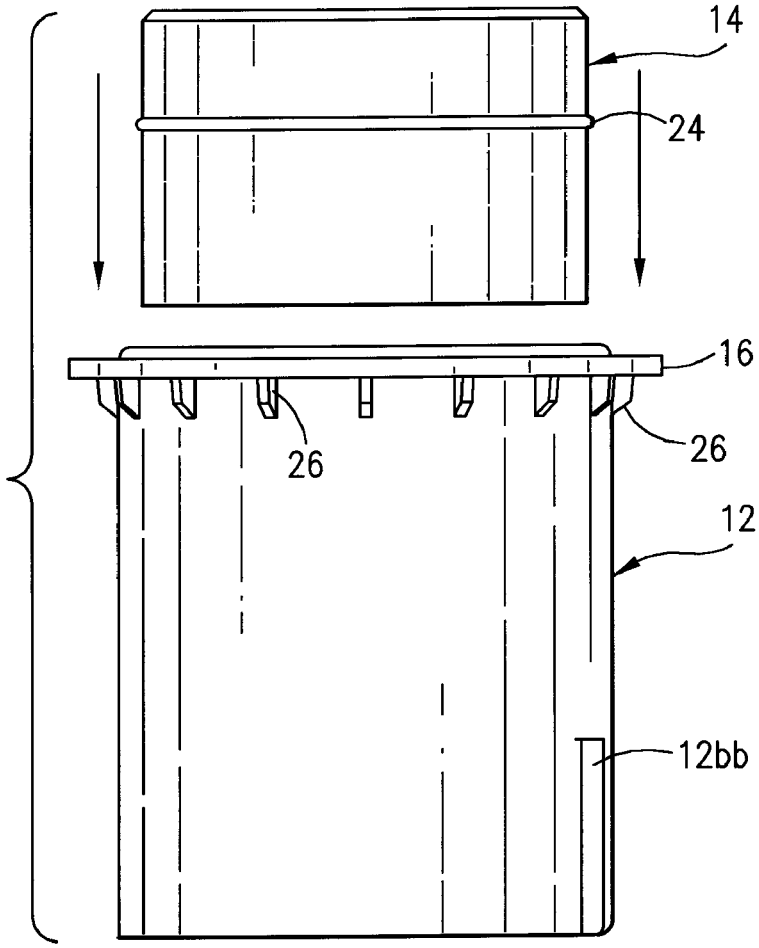
FIG. 2 shows an exploded side elevational view of the present invention.

Referring now to FIG. 2, the present invention is shown with the second member 14 which is cylindrical having an open bottom above the first member 12 that is used to contain ingredients that will ultimately be dispensed into another container such as a bottle or package. Second member 14 which is in effect the mechanical plunger includes an integrally formed annular bead 24 that extends above the surface of the outside cylinder wall of second member 14. The purpose of the annular bead 24 is to seal second member 14 inside first member 12 at a predetermined location once the ingredients have been placed in second member 12. Also note on the outside wall of first member 12, there is a line of weakening shown represented by line 12*bb* on one lower area of the outside wall of first member cylinder 12.

Also note in FIG. 2, the extended annular lip 16 includes flow-by apertures and extends outwardly around the open top portion of first member 12. The purpose of lip 16 is provide a mount inside a bottle cap neck to support the entire capsule inside a bottle without the capsule 10 falling into the container. The lip 16 also includes a plurality of apertures that allow liquid to flow by the entire outside capsule body through the apertures so that a person can drink out of a container containing a liquid that has been mixed with the ingredients after the device is activated. Further mounting members 26 are radial arms protruding away from the sides of first member 12 disposed around its upper periphery.

Figure 3:
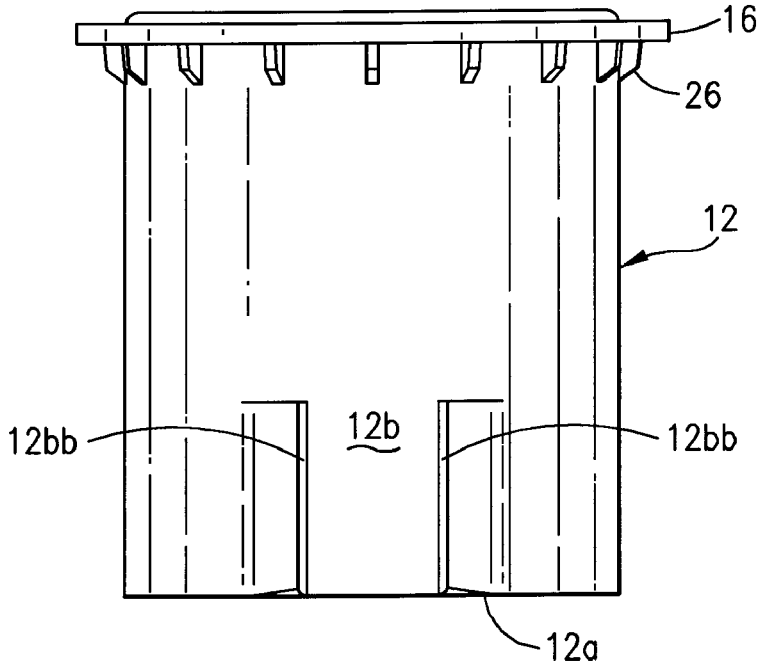
FIG. 3 shows a side elevational view in the direction of the lines of weakening of the invention.

Referring now to FIG. 3, a front elevational view shows the entire area of weakening 12*b* which is substantially rectangular section of the curved cylindrical wall forming the cylindrical body wall for first member 12. The purpose of the lines of weakening 12*bb* is to provide a substantial area 12*b* in the first member 12 wall that can be torn away and separated from the main body 12 when the plunger rod 20 is activated by depressing the second member 14.

Referring now to FIGS. 4 and 4A, the invention is shown in a non-activated disposition. What is not shown in FIG. 4 are the ingredients which would have already been provided to the inside chamber formed by the union of the first member 12 and the second member 14 which are shown in a sealed arrangement. No ingredients are shown in the embodiment in FIG. 4 even though it would normally be filled with ingredients, either powder or liquid.

Referring now to FIG. 4A, the junction point between the side cylindrical body 12 and the bottom wall 12*a* include a line of weakening 12*aa* all the way around the base or bottom wall 12*a*.

Referring now to FIG. 5, the invention is shown after it has been activated and the ingredients have been dispensed. It can be readily seen that second member 14 has been depressed downwardly. The second member 14 cannot be pushed any farther because of an annular lip 12*c* above the bottom weakened wall 12*a* having a diameter that is smaller than the outside diameter of second member 14. More importantly, however, is the position of the plunger tube 20 that is integrally formed with the weakened bottom 12*a*. Because of the lines of weakening 12*a*, when the second member is depressed downwardly, the bottom wall 12*a* is ruptured separating the wall 12*a* from the cylindrical body 12 including a rectangular area 12*b* along its cylindrical wall periphery as shown in FIG. 3. The construction prevents the bottom wall 12*a*, the plunger tube 20 and the second member 14 from accidentally falling into a container to which the entire capsule has been mounted. In this position, the container (which is not shown in FIG. 5) can still dispense the combined ingredients through lip 16 which includes apertures allowing the combined liquid in the container to be dispensed through the top of the container or through the neck of the container.

Figure 6:
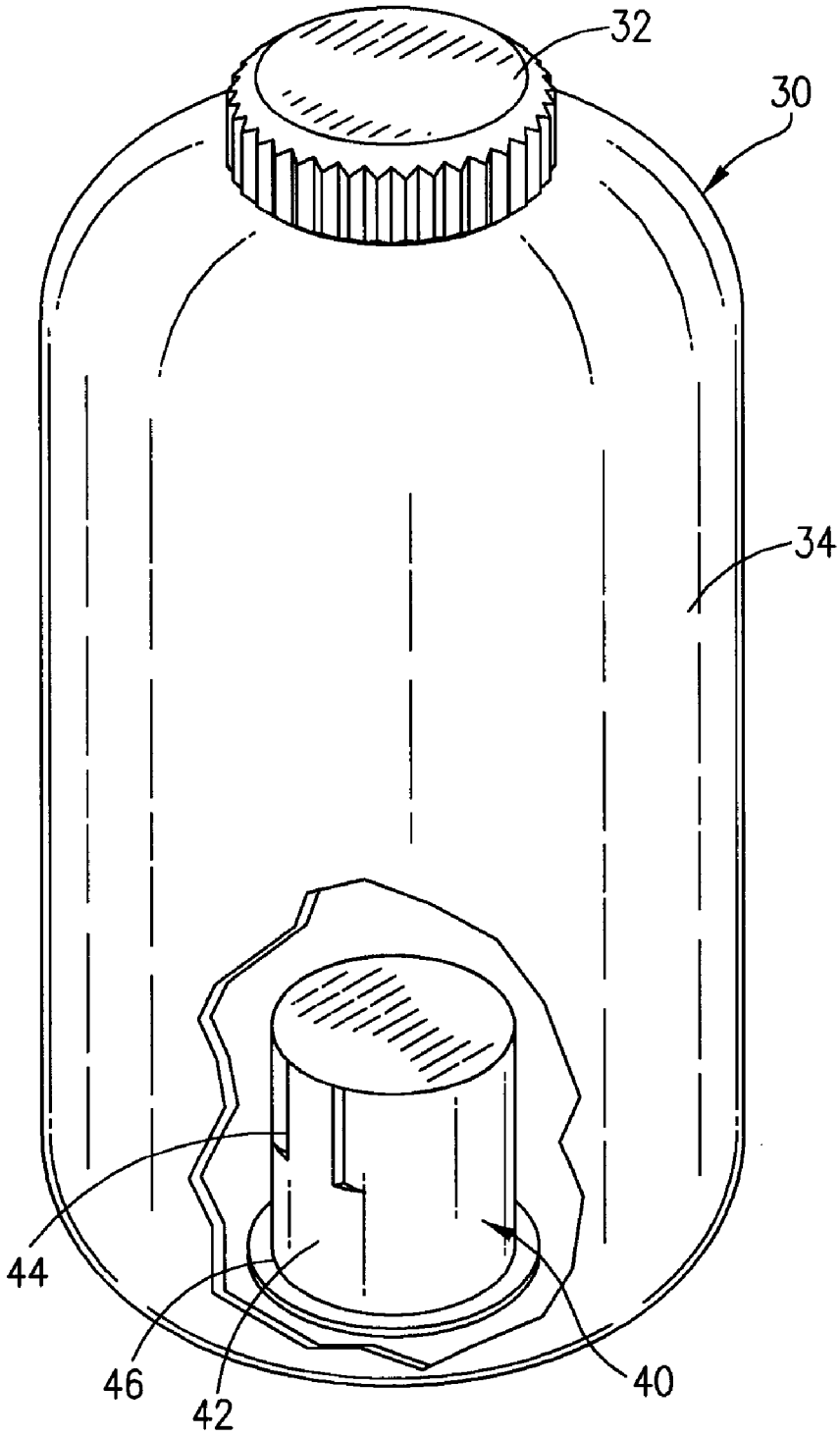
FIG. 6 is a perspective view of the preferred embodiment of the invention as mounted in the bottom of a bottle.

Referring now to FIG. 6, a plastic bottle or container 30 is shown that has a conventional screw on bottle cap 32. The body 34 of the container 30 can be constructed of plastic or other liquid impervious material. The contents of the container 30 could be a liquid such as water or other type of drink. Mounted in the bottom of the container 30 is capsule 40 containing a powder or liquid to be dispensed into container 30 at the appropriate time. The capsule 40 is heat fused around annular ring 46 which does not have any apertures as shown in the previous embodiments in FIGS. 1 through 5. The solid annular ring 46 is heat sealed or glued at the factory to the container 30 bottom through an aperture in the bottom. The cylindrical body 42 of capsule 40 could also be molded integrally with the container 30. The lines of weakening 44 are shown in capsule 40 and work as discussed previously in FIGS. 1 through 5 herein. The capsule top (plunger), not shown in FIG. 6, can be depressed from the bottom, tearing open the bottom of the capsule 40 and the lines of weakening 44, dispensing whatever materials are in capsule 40 at the appropriate time. At that time, the entire contents of container 30 including the dispensed material from capsule 40 can be poured out of container 30 through the opening covered by the screw on cap 32.

Figure 7:
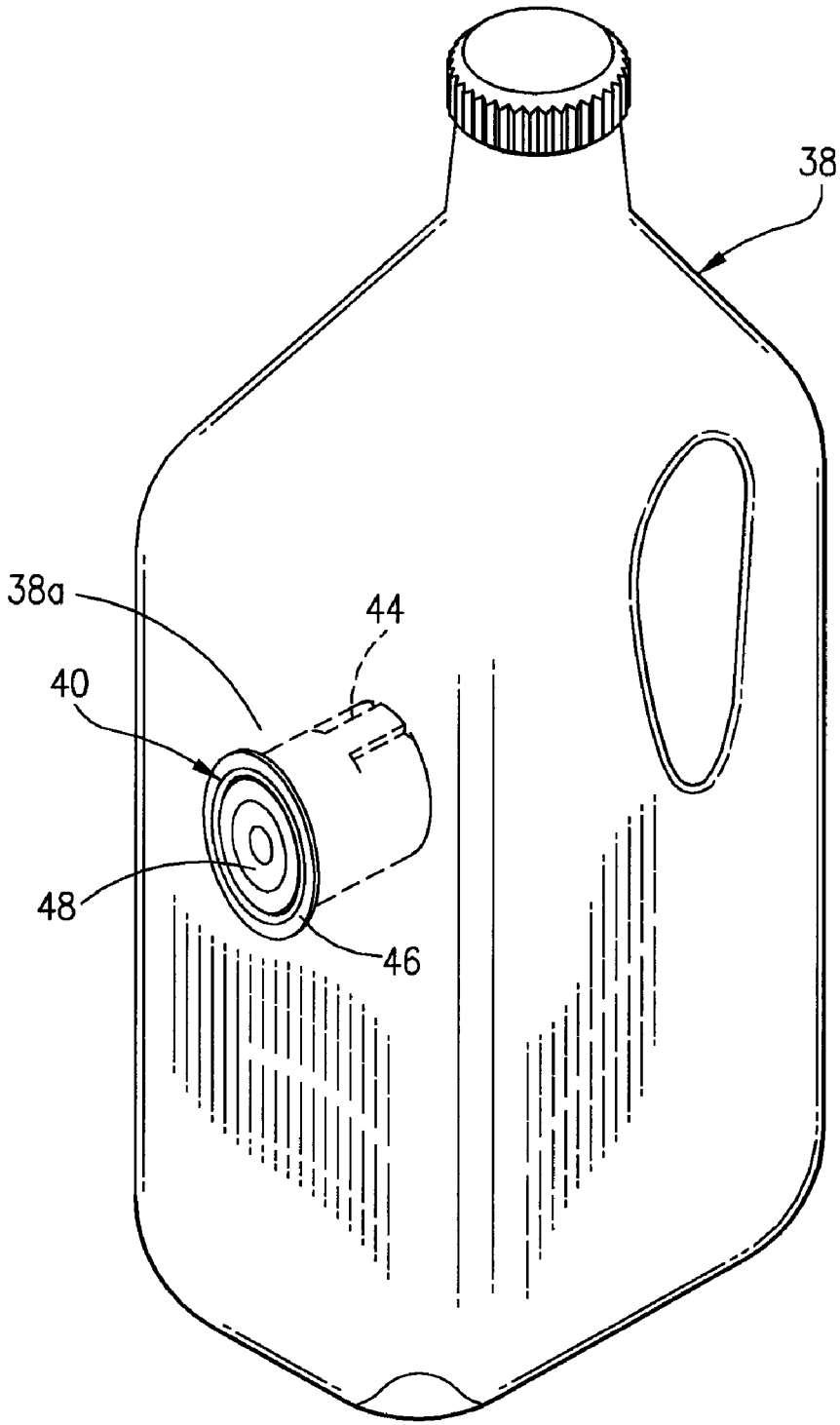
FIG. 7 is a perspective view of the preferred embodiment of the invention mounted in a plastic milk container.

Referring now to FIG. 7, a conventional plastic container such as milk container 38 is shown that has capsule 40 connected through one wall 38*a* of container 38 by heat sealing or gluing annular ring 46 to wall 38*a* through an aperture in the wall. The second member (plunger) 48 is shown that can be manually depressed causing the contents in capsule 40 to be dispensed into the container 38.

Figure 8:
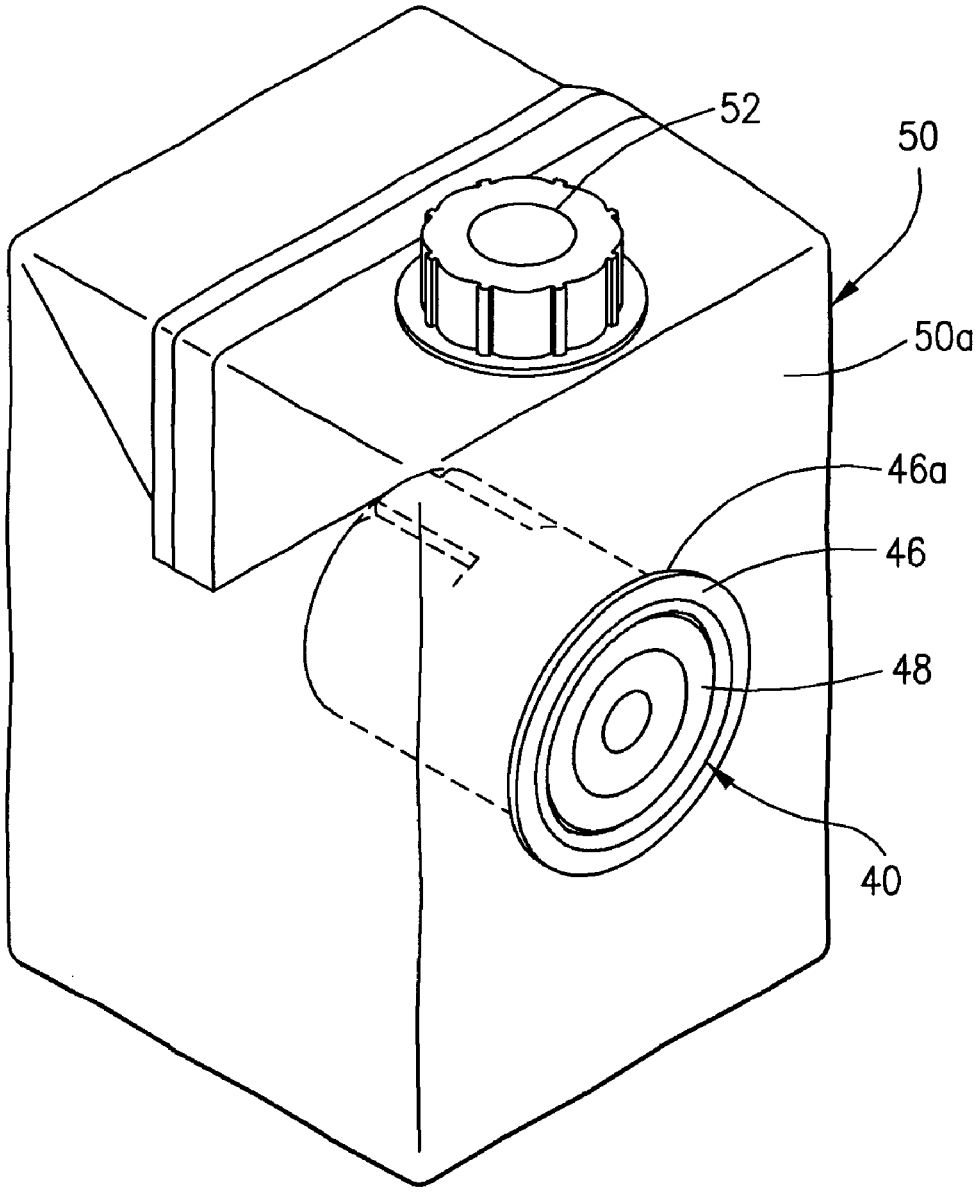
FIG. 8 is a perspective view of the preferred embodiment of the invention mounted in a paper like liquid container.

FIG. 8 shows a liquid carton 50 that can hold a variety of liquids. The carton 50 has a conventional screw off top 52 and a cube-like body made from waterproof paper, plastic or other types of materials to constitute a fold up sealed carton 50. Mounted through one wall 50*a* is capsule 40. The annular ring or lip 46 is sealably heat sealed or glued or appropriately attached to wall 50*a* of carton 50 at 46*a* through an aperture in wall 50*a*. The capsule second member (plunger) 48 can be depressed, dispensing powder or liquid contents from capsule 40 into carton 50. The capsule 40 is mounted with the capsule body inside container 50 mounted through a hole in wall 50*a* and sealed or glued to the wall 50*a*. The contents of the capsule 40 is loaded at the factory with liquid or powder and the capsule top (plunger) 48 is sealed to the capsule body.

Figure 9:
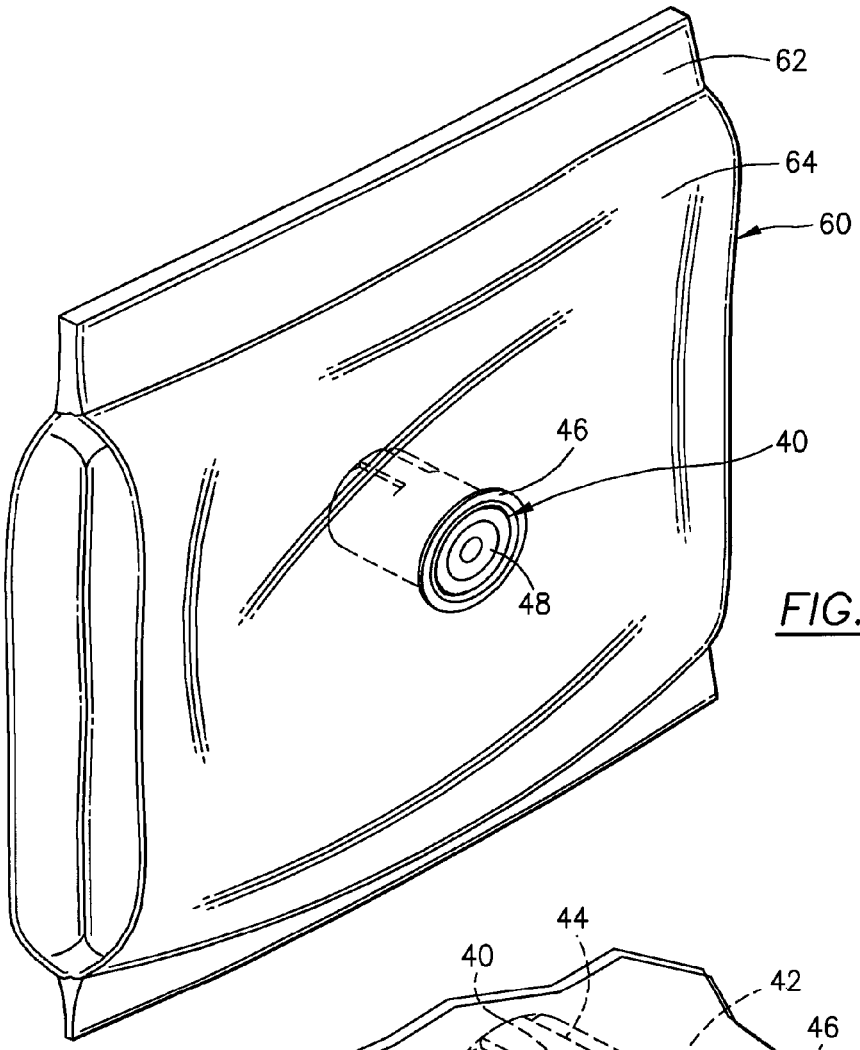
FIG. 9 is a perspective view of the preferred embodiment of the invention mounted in a package containing a liquid.

FIG. 9 shows a flexible liquid impervious pouch 60 that can be plastic, paper or other waterproof or liquid-proof material that is sealed and openable along the top 62. Sealably mounted in the sidewall 64 is capsule 40 along the annular lip 46 by glue or heat seal. The capsule top (plunger) 48 can be activated to dispense the contents of capsule 40 into the container 60.

Figure 10:
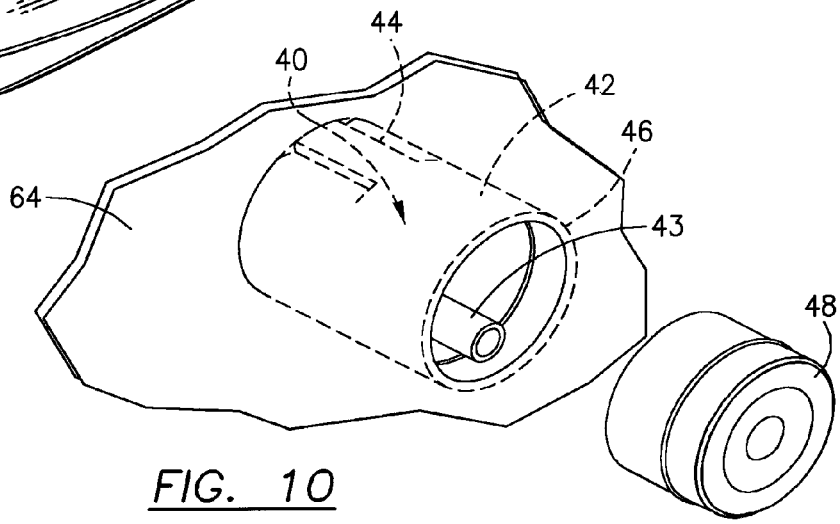
FIG. 10 is a cutaway exploded view of a capsule first member integrally molded in the body of a container and the plunger shown exploded above.

Referring now to FIG. 10, the capsule 40 is shown mounted in wall 64 by heat sealing along the annular lip 46. The capsule top (plunger) 48 is shown exploded as a separate element as described in FIG. 1 through 5 herein. The sealing action of the plunger 48 is as described above. Because the pouch in FIG. 9 can be opened along the top edge portion 62, the materials once dispensed inside pouch 60 can be mixed and dispensed through the top opening 62. Therefore, if the capsule is mounted in one of the wall of a container body and not used in the conventional neck or opening of the container, there is no need for apertures in the annular lip 46 that were necessary to allow liquid to flow through the neck of a bottle. In the embodiments shown in FIGS. 6 through 9, the annular lip 46 is solid and is attached permanently. The lip 46 is sealed to prevent liquid from leaking from a container around the capsule cylinder.

Figure 11:
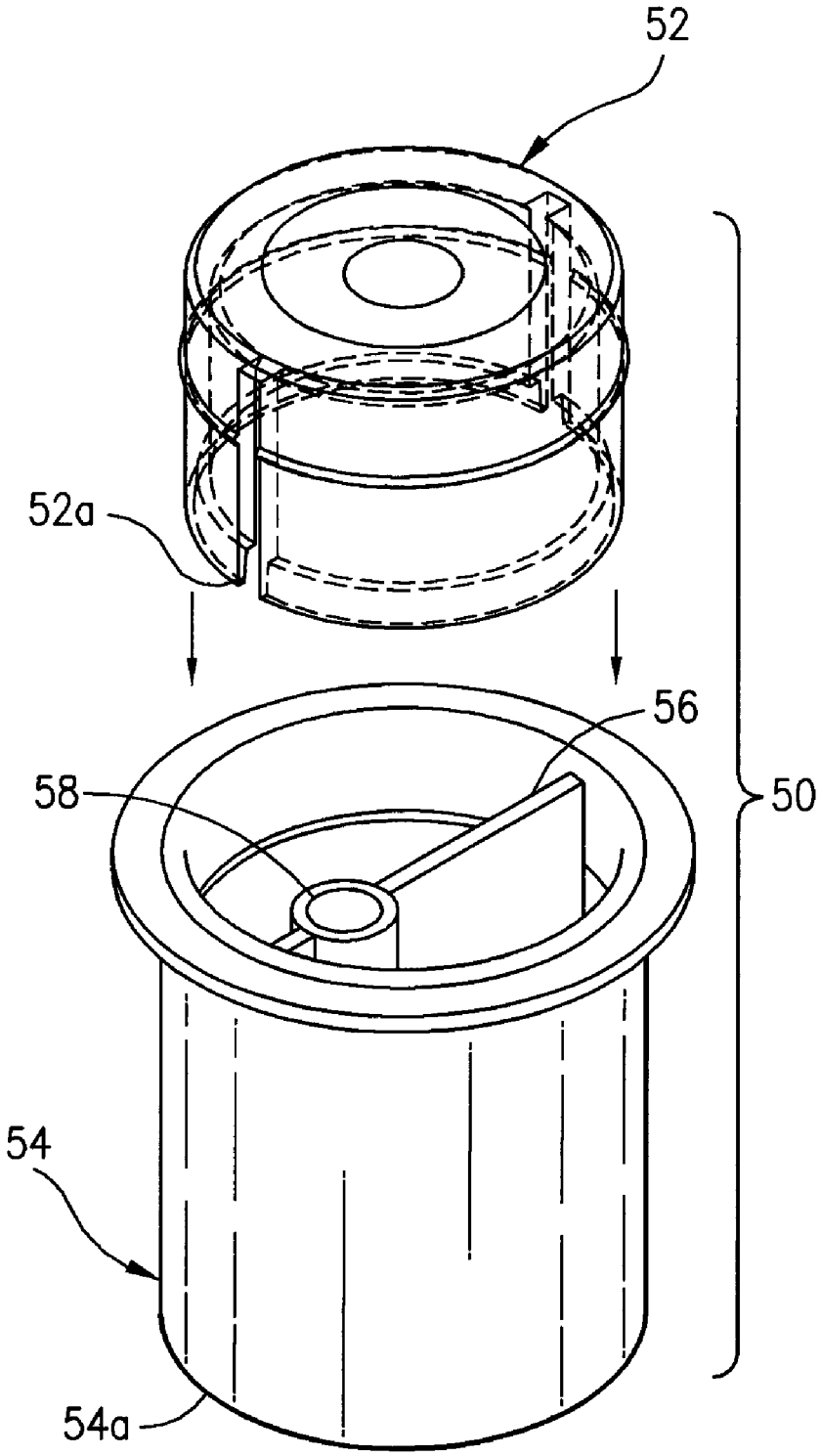
FIG. 11 is an exploded view of a first member of an alternate embodiment that has a capsule with two separate compartments in one capsule.

Referring now to FIG. 11, an alternate embodiment of the present invention is shown in which the capsule 50 is comprised of first member 54 and second member (plunger) 52. The first member 54 is a cylinder that includes an interior wall 56 that is mounted across the inside of the first member 54 diametrically forming a separation wall 56 to separate two separate ingredients that can be inserted into first member 54 at the factory. Thus, two different active ingredients can be contained in the same capsule 54. The plunger rod 58 can form part of the wall in the molding process and acts as described above. The second member (plunger) 52 includes slotted walls 52*a* diametrically opposed that allow the second member 52 to slide downward for sealing inside the first member 54 at the factory. The second member 52 is a plunger and can be pushed downwardly to tear away the lines of weakening in the bottom 54*a* of the capsule so that both ingredients are dispensed at the same time.

Figure 12:
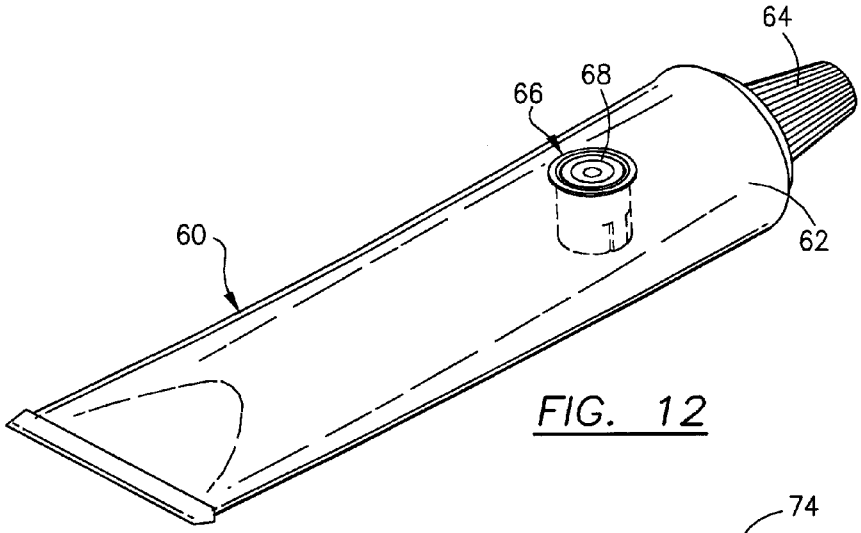
FIG. 12 is a tube showing the present invention.

Referring now to FIG. 12, another alternate embodiment of the invention is shown in which a squeezable tube 60 similar to a toothpaste tube having a tube body 62 made of a resilient or squeezable material includes a removable cap 64. Sealed through one wall 62 of tube 60 is a capsule 66 that has a second member (plunger) 68 for activating a second material put in capsule 66. If tube 62 contains toothpaste, capsule 66 could contain whitener that should not be activated until time of use. This would greatly extend the shelf life of toothpaste or any other ingredient that can be placed in a squeezable tube.

Figure 13:
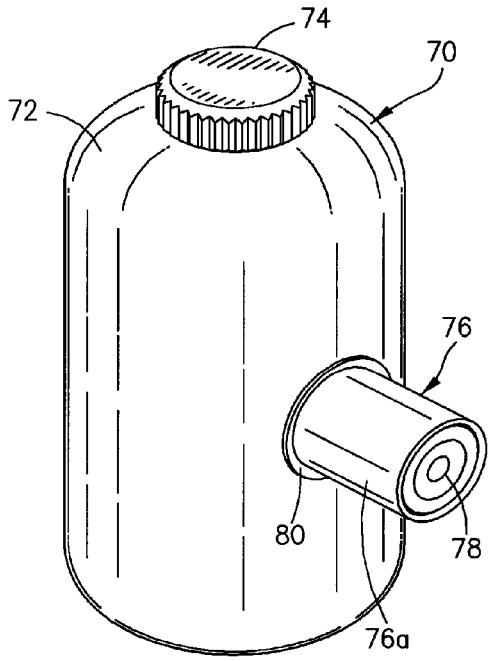
FIG. 13 is an alternate embodiment of the invention having a capsule mold or sealably attached and protruding from the container body.

FIG. 13 shows yet another alternate embodiment of the invention. A conventional plastic container 72 having a removable cap 74 includes a capsule 76 that is heat sealed or glued through a hole along glue line 80 in the wall 72. The second member (plunger) 78 can be manually depressed to dispense the ingredients. The first member 76*a* is cylindrical with a bottom wall having lines of weakening as described above with respect to the capsule invention. Thus, the capsule 76 as described in the invention herein is thus physically attached and mounted to a hole in wall 72. In yet another embodiment, portions of the first member of the capsule 76 could be pre-molded as part of the container 70 including lines of weakening and the plunger rod as described herein.

Thus, as shown, the capsule 40 can be a separately mounted within the neck of a bottle or can be permanently affixed and sealed as part of the wall of any container for dispensing. When placed in the neck of a container opening, the container inside neck wall and the capsule can have snap in grooves and rings to make the capsule unremoveable.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A capsule connected through a container wall that contains a substance to be subsequently dispensed into a container comprising:

a container for liquids having a container wall;

a capsule body that is impervious to liquid connected through said container wall;

said capsule body, including a first member and a second member, said second member moveable mountable in said first member;

said capsule first member body having a top opening and a sealed closed bottom with lines of weakening and a vertical plunger tube connected thereto;

said second member having a sealed closed top and an open bottom forming a plunger; and said first and second members in a first mode are sealed together forming said capsule body preventing any liquid or dry material from escaping from the capsule body; and said second member sized in length to engage said plunger tube when depressed to displace material in said capsule.

2. A capsule as in claim 1, wherein:

said first member is cylindrical and said second member is cylindrical; and the inside diameter of said first member being larger than the outside diameter of the said second member.

3. A capsule as in claim 2, wherein:

said first member side cylindrical wall and said sealed bottom having a joined area of weakened material around its periphery, for rupture by said second member engaging said plunger tube.

4. A capsule as in claim 2, wherein:

said first member inside wall has a sealing means that engages said second member.

5. A capsule as in claim 1, wherein:

said second member having a removeable area to form an aperture for inserting a straw.

6. A capsule as in claim 1, including:

the capsule body having a first member that is integrally molded as part of the container with the container wall.

7. A capsule as in claim 6, wherein:

the first member capsule body is integrally molded and protruding outwardly from said container wall.

8. A capsule as in claim 1, wherein:

said container is tubularly shaped and is made from a squeezable material.

9. A capsule as in claim 1, wherein:

said container is shaped like a conventional milk container.

10. A capsule as in claim 1, wherein:

said container is a baby bottle.

11. A capsule connected through a container wall that contains a substance to be subsequently dispensed into a container comprising:

a container for liquids having a container wall;

a capsule body that is impervious to liquid connected through said container wall;

said capsule body including a cylindrical first member and a cylindrical second member with said second member moveably mountable in said first member;

wherein the inside diameter of said first member is larger than the outside diameter of the said second member;

said capsule first member body having a side cylindrical wall, an inside wall, a top opening, and a sealed closed bottom with lines of weakening and a vertical plunger tube connected thereto;

wherein said first member side cylindrical wall and said sealed bottom have a joined area of weakened material around their periphery for rupture by said second member engaging said plunger tube;

wherein said first member inside wall has a sealing means that engages said second member;

said second member having a sealed closed top and an open bottom forming a plunger;

wherein said second member has a removeable area to form an aperture for inserting a straw; and said first and second members in a first mode are sealed together forming said capsule body preventing any liquid or dry material from escaping from the capsule body; and said second member sized in length to engage said plunger tube when depressed to displace material in said capsule.

12. The capsule of claim 11, wherein the capsule body has a first member that is integrally molded as part of the container with the container wall.

13. The capsule of claim 12, wherein the first member capsule body is integrally molded with and protrudes outwardly from said container wall.

14. The capsule of claim 11, wherein said container is tubular in shape and is made from a squeezable material.

15. The capsule of claim 11, wherein said container is shaped like a conventional milk container.

16. The capsule of claim 11, wherein said container is a baby bottle.

* * * * *